United States Patent [19]

Mathis

[11] 4,226,472

[45] Oct. 7, 1980

[54] UNATTACHED BASE FOR ROCKING CHAIRS

[76] Inventor: Eldon R. Mathis, 2216 SW. 63rd St., Oklahoma City, Okla. 73159

[21] Appl. No.: 5,335

[22] Filed: Jan. 22, 1979

[51] Int. Cl.[2] ..... A47C 3/02

[52] U.S. Cl. ..... 297/270; 5/106

[58] Field of Search ..... 5/105, 106; 297/270, 297/DIG. 7; 188/32; D12/217

[56] References Cited

U.S. PATENT DOCUMENTS

| | | | |
|---|---|---|---|
| 597,071 | 1/1898 | Sigurdson | 5/3 |
| 633,398 | 9/1899 | Straube | 297/270 X |
| 1,292,061 | 1/1919 | Rick | 297/270 X |
| 1,323,946 | 12/1919 | Wright | 297/270 |
| 2,325,716 | 8/1943 | Streit | 297/270 X |
| 2,407,839 | 9/1946 | Lemos | 297/270 X |
| 3,352,601 | 11/1967 | Cycowicz | 297/270 X |
| 4,021,867 | 5/1977 | Maxwell | 5/106 |

*Primary Examiner*—James C. Mitchell

*Attorney, Agent, or Firm*—William R. Laney

[57] ABSTRACT

The unattached base of the present invention includes a spacing element and two stop members integrally formed with, but extending perpendicularly from, the spacing element. The spacing element establishes a predetermined distance between the inside surfaces of the stop members. The stop members also have predetermined heights and lengths.

5 Claims, 4 Drawing Figures

UNATTACHED BASE FOR ROCKING CHAIRS

BACKGROUND OF THE INVENTION

1. Field of the Invention

This invention relates generally to apparatus for preventing the rocking movement of a rocking chair and more particularly, but not by way of limitation, to unattached apparatus which may be placed under platform rockers or rocker-recliners to prevent the rocking thereof.

2. Description of the Prior Art (Prior Art Statement)

The following statement is intended to be a prior art statement in compliance with the guidance and requirements of 37 C.F.R. 1.56, 1.97 and 1.98.

U.S. Pat. No. 633,398 issued to Straube discloses a combined rocking chair and bath which is proposed to include a plurality of blocks for placement under the curved rocker bars of the rocking chair to adjustably fix the position of the bath.

U.S. Pat. No. 1,323,946 issued to Wright indicates on anit-rocking device for rocking chairs. This device is proposed to be a strip of metal having one end attached to a block and having the other end pivotally connected near the front end of the bottom surface of a curved rocker bar. It will be noted upon examination of FIG. 2 of the Wright patent that the attachment of a single device to a rocking chair does not necessarily totally immobilize the chair because rearward rocking can still be obtained.

In addition to the above proposals which need not be initially constructed with the integral parts of a rocking chair, there are anti-rocking devices which have been proposed as integral parts of their respective rocking chairs.

U.S. Pat. No. 1,292,061 issued to Rick proposes one such type of chair. This proposal converts from a rocking mode to a non-rocking mode by having the rear portions of its rocker bars pivoted upward to provide a footing between the pivot points and the surface upon which the rocking chair is placed.

U.S. Pat. No. 2,325,716 issued to Streit discloses another chair having rocker elements which are convertible from a rocking mode to a non-rocking mode. This patent proposes a rear support element which is pivotally connected to the base of the chair. By appropriately rotating the rear structure, either a fixed position or a rocking position is obtained.

Still another convertible rocking chair is dislosed in U.S. Pat. No. 2,407,839 issued to Lemos. This chair is proposed to include rocker bar members which are pivotally connected to stationary front legs of the chair for pivoting thereabout by means of mechanical linkages. When the linkages are in one position, the rocker bars are lowered to provide a rocking mode. When the linkages are in another position, the rocker bars are raised to provide a non-rocking mode.

In addition to the above patents, Applicant also knows of one patent which is directed to rocker-recliners. In this patent, U.S. Pat. No. 3,352,601 issued to Cycowicz, there is proposed a chair having integral thereto a mechanical linkage which can be manipulated to prevent the chair from rocking.

These patents indicate that there is a need for a device which prevents a rocking chair from rocking. However, there is also a need for such a device to be a single stucture to obviate the need of having to place a plurality of individual elements at a plurality of locations under the chair. There is also the need for such a device to completely stop both the forward and rearward rocking movements.

A further need is for such a structure to be compact so that it can be easily handled by the user. Such compactness will insure that such a device will be unobtrusive to both a person sitting in the chair and a person walking in the vicinity of the chair.

Still another need is for the device to be unattached from the rocking chair. Having the device unattached allows it to be used with previously manufactured chairs and precludes having to redesign future chairs to incorporate an integral-type stopping device. This creates savings in the size, weight and cost of future rocking chairs; yet permits the rocking movement to be stopped as desired.

Also there is a need for such a device to be free of moving mechanical parts to reduce maintenance.

Despite the existence of these needs, the prior art known to Applicant fails to satisfy them. In general, the previously mentioned patents fail to propose anti-rocking devices which obtain complete stoppage of rocking movement with a single element device. Some of the patents fail to propose devices free to mechanical linkages. Many of the proposed devices are not unattached from their chairs which thus may add to the bulk, obtrusiveness and expense of the chairs.

In light of these and other shortcomings, Applicant believes that no previously disclosed device which is known to him indicates, either singly or in combination, the present invention.

SUMMARY OF THE INVENTION

The present invention overcomes the above-noted and other shortcomings of the prior art by providing a novel and improved unattached base for rocking chairs. This base provides a rigid means for completely stopping the rocking movement of a rocking chair. Additionally, the present invention contemplates, in a preferred embodiment, a single unitary structure to provide this rigid means. Further, the present invention is compact for ease of disposition beneath the rocking chair and for preclusion of obstruction to both persons in and around the chair. Still further, the present invention is unattached from the rocking chair. The present invention also has no moving mechanical parts which require maintenance.

The unattached base of the present invention includes a spacing element and first and second stop means extending perpendicularly from the spacing element in the same direction. The spacing element establishes a distance between the inside surfaces of the two stop means which is approximately equal to the width of the rocking chair support structure. Each stop means has a height which is approximately the same as the distance between the surface upon which the chair is placed and the underside of the frame of the chair. Each stop means also has a length which is sufficient to extend the stop means on both sides of the axis of pivot of the chair when the base is properly placed under the chair.

Therefore, from the foregoing, it is a general object of the present invention to provide a novel and improved unattached base for rocking chairs. Other and further objects, features and advantages of the present invention will be readily apparent to those skilled in the art upon a reading of the description of the preferred embodiment which follows when taken in conjunction with the accompanying drawings.

DETAILED DESCRIPTION OF THE PREFERRED EMBODIMENT OF THE INVENTION

Figure 1:
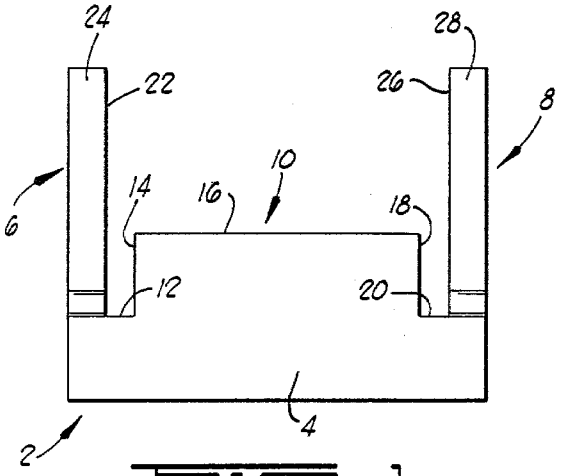
FIG. 1 is a top plan view of the preferred embodiment of the present invention.
Figure 2:
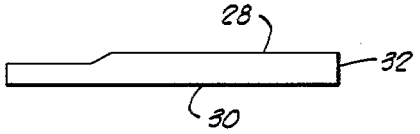
FIG. 2 is a side elevation view of the preferred embodiment of the present invention.

Referring now to the drawings and in particular to FIGS. 1 and 2, two views of an unattached base 2 of the present invention are shown. In the preferred embodiment, the base 2 is a single member structure made of, for example, wood, plastic or fiberglass. Although the preferred embodiment is a single integrally formed structure, the unattached base 2 could have, in other embodiments, detachable or adjustable individual elements which are combined to function as a unit. Further, although the preferred embodiment base is a single structure, the discussion below will refer to separate portions of such single structure as if they were discrete elements. In particular, the preferred embodiment includes a spacing element 4, a first stop means 6, and a second stop means 8.

The spacing element 4 is the portion of the base 2 which defines the inner width of the base 2. Although in the preferred embodiment the spacing element 4 is part of the single structure of the base 2, in other embodiments the spacing element 4 may include a plurality of parts which are adjustably connected for adjusting the inner width of the base 2.

In the preferred embodiment shown in FIG. 1, the spacing element 4 includes a first side 10 which is constituted of a first segment 12, a second segment 14, a third segment 16, a fourth segment 18, and a fifth segment 20. The lengths of the segments 12, 16 and 20 define the inside width of the base 2. Although the third segment 16 is shown to be offset from the first segment 12 and the fifth segment 20, these segments may be co-linear in other embodiments. In the preferred embodiment, however, the segment 16 is offset from the segments 12 and 20 by the segments 14 and 18 which extend perpendicularly from the segments 12 and 20 to the segment 16.

The first stop means 6, likewise, extends perpendicularly, from the segment 12 of the spacing element 4. The first stop means 6 may be removably attached to the spacing element 4 although it is not in the preferred embodiment because of the unistructural nature of the preferred embodiment. The first stop means 6 includes a first inside surface 22 which extends parallel to the second segment 14. The first stop means 6 also includes a first top surface 24 which, in the preferred embodiment, joins the upper edge of the inside surface 22 at right angles.

The second stop means 8 extends perpendicularly from the fifth segment 20 in spaced relation to, and in the same direction as, the first stop means 6. As with the first stop means, the second stop means 8 may be removably attachable to the spacing element 4 in other embodiments. Also, the second stop means 8 includes a second inside surface 26 which extends parallel to the fourth segment 18. The second stop means 8 also includes a second top surface 28 which adjoins the second inside surface 26 at right angles. As shown in FIG. 2, the second stop means 8 also includes an underside surface 30 and an end surface 32. It is to be noted that the first stop means 6 has a similar underside surface and end surface.

The linear distance between the inside surfaces 22 and 26 is defined as the inner width of the base 2, and, as described above, is determined by the length of the segments 12, 16 and 20.

The height of each of the stop means 6 and 8 is defined as the linear distance between the respective underside and top surfaces. In the preferred embodiment this height is equal to the length of the end surface 32.

The length of the stop means 6 is the linear distance measured along the first inside surface 22 between the segment 12 and the end surface of the stop means 6. Likewise, the length of the second stop means 8 is the linear distance taken along the second inside surface 26 between the segment 20 and the end surface 32.

Figure 3:
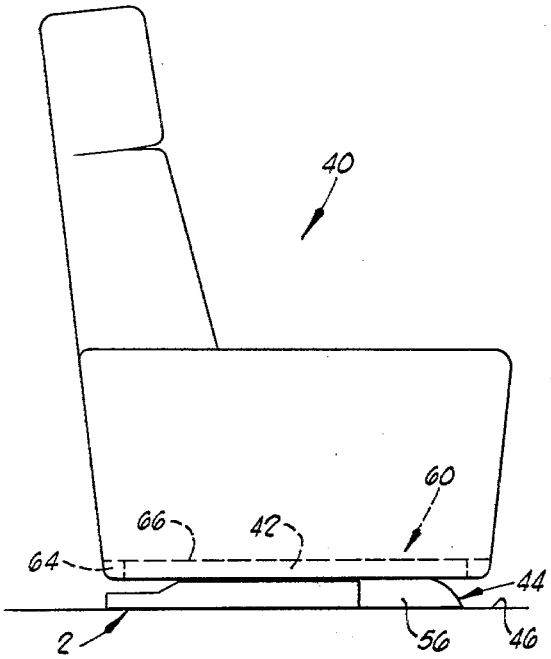
FIG. 3 is a side elevation view of the present invention placed beneath a rocking chair.
Figure 4:
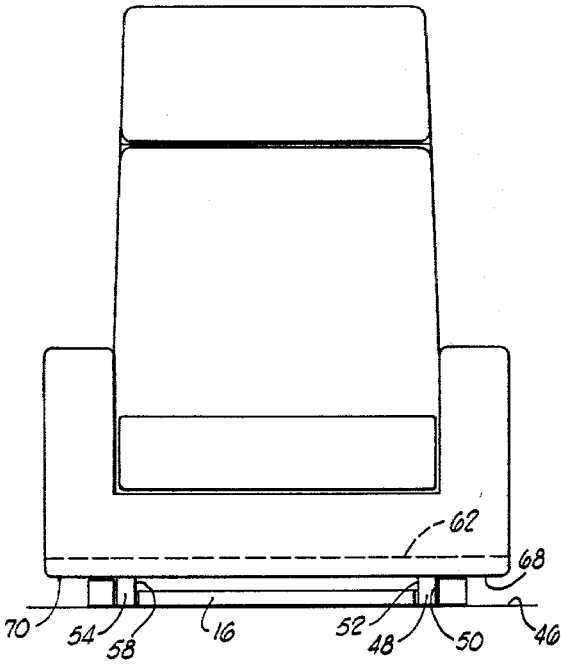
FIG. 4 is a front elevation view of the preferred embodiment of the present invention placed beneath a rocking chair.

With reference now to FIGS. 3 and 4, the placement of the base 2 for preventing the rocking movement of a rocking chair 40 will be described. First, however, certain elements of the chair 40 will be described. In particular, the rocking chair 40 is a platform rocker or a rocker-recliner. In FIG. 3, the pivot axis, or line, of the rocking chair 40 is indicated by an end point 42.

To provide the pivot line, there is a stationary element 44 which is the pedestal for supporting the chair on a supporting surface 46, such as a floor. The stationary element 44 includes a first support member 48 having a first outside surface 50 and a first inner surface 52. The stationary element 44 also includes a second support member 54 having a second outside surface 56 and a second inner surface 58.

In addition to the stationary element 44, the chair 40 includes a frame 60. In the preferred embodiment, the frame 60 is rectangular and includes a front structural member 62, a first side structural member (not shown) perpendicularly connected to the front structural member 62 at one end, a rear structural member 64 perpendicularly connected to the first side structural member and parallel to the front structural member 62, and a second side structural member 66 connected to the ends of the front structural member 62 and rear structural member 64 opposite those ends to which the first side structural member is connected. This assemblage of structural elements provides first and second bottom surfaces 68 and 70 under the first and second side structural members, respectively.

To prevent the rocking of the rocking chair 40, the base 2 is placed under the frame 60 adjacent the stationary member 44. Such placement can be made from the rear, the front or the side of the chair 40. Placement is from the rear in the preferred embodiment. More particularly, the underside surface 30 of the base 2 is placed adjacent the surface 46. The first top surface 24 is disposed adjacent the first bottom surface 68, and the second top surface 28 is disposed adjacent the second bottom surface 70. The first inside surface 22 is placed adjacent the first outside surface 50, and the second inside surface 26 is placed adjacent the second outside surface 56. Although not shown in the drawings, the first segment 12 is placed adjacent the back edge of the first support member 48, and the fifth segment 20 is placed adjacent the back edge of the second support member 54. Also, the second segment 14 is disposed adjacent the first inner surface 52, and the fourth segment 18 is disposed adjacent the second inner surface 58.

To have a placement of the base 2 as just described, it will be observed that the linear distance between the inside surfaces 22 and 26, previously identified as the inner width of the base 2, must be approximately equal to, but not less than, the width of the stationary element 44 as defined by the shortest linear distance between the outside surfaces 50 and 56. Thus, this linear distance between the outside surfaces predetermines the magnitude of the inner width of the base 2. Also, the height of the stop means 6 and 8, previously defined as the distance between the tops and underside surfaces thereof, must be approximately equal to the shortest linear distance between the surface 46 and the bottom surfaces 68 and 70 of the frame 60 at the pivot line as shown in FIG. 3. Thus, the stop means have predetermined heights. Still further, the lengths of the stop means 6 and 8 should extend from the rear edges of the support members 48 and 54 to a point beyond the pivot line 42 so stoppage of both forward and rearward rocking is obtained. Therefore, the lengths of the stop means are predetermined according to the location of the line of pivot.

By so configuring, dimensioning, and placing the base 2, the present invention of a device for stopping the rocking motion of a rocking chair is obtained. Such a base is unattached so that it can be used with any appropriate rocking chair. Additionally, this base is compact for complete placement underneath the chair so that it is out of the way. Further, the uni-structural nature of the base provides for single installation which obviates the need for making a plurality of placements of items to prevent rocking. Still further, the present invention has no moving mechanical parts which could malfunction and require maintenance.

Thus, the present invention of an unattached base for rocking chairs is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A device for placing under a rocking chair to prevent the rocking thereof, which rocking chair has a stationary element for supporting said chair on a surface, said stationary element having oppositely disposed outside surfaces, and which rocking chair also has a frame disposed over, and in pivotable engagement with, along a pivot axis, said stationary element at a predetermined distance above said surface at said pivot axis, said device comprising:

a spacing element having a first side defining a linear magnitude approximately equal to the distance between said outside surfaces of said stationary element of said rocking chair;

a first stop means having a height approximately equal to the predetermined distance said frame is above said surface and extending perpendicularly from said first side of said spacing element; and a second stop means having a height approximately equal to the predetermined distance said frame is above said surface and extending perpendicularly from said first side of said spacing element in spaced relation to said first stop means at a distance defined by said linear magnitude.

2. The device as recited in claim 1, wherein:

said first and second stop means have respective inside surfaces for adjacent location along respective ones of said outside surfaces of said stationary element of said rocking chair.

3. The device as recited in claim 2, wherein:

said first side of said spacing element has two segments disposed parallel to said first and second stop means for adjacent location along respective inner surfaces of said stationary element of said rocking chair.

4. A system for preventing rocking chair movement, comprising:

a rocking chair having:

a pedestal for supporting said chair on a surface; and a rectangular frame movably connected along a pivot line to said pedestal and overlying said pedestal at a predetermined distance above said surface, said rectangular frame including:

a front structural member;

a rear structural member in parallel spaced relation to said front structural member;

a first side structural member interconnecting said front and rear structural members and having a first bottom surface extending on both sides of said pivot line; and a second side structural member interconnecting said front and rear structural members in spaced relation to said first side structural member and having a second bottom surface extending on both sides of said pivot line; and a base removably associated with said pedestal and said frame for preventing said movable relationship between said pedestal and said frame, said base including:

a spacing member;

a first stop means extending perpendicularly from said spacing member and having a first top surface for adjacent location under and on both sides of said pivot line along said first bottom surface of said first side structural member of said frame; and A second stop means extending perpendicularly from said spacing member in spaced relation to said first stop means and having a second top surface for adjacent location under and on both sides of said pivot line along said second bottom surface of said second side structural member of said frame.

5. The system as recited in claim 4, wherein:

said pedestal includes a first support member, having a first outside surface, and a second support member, having a second outside surface;

said first stop means includes a first inside surface for adjacent location along said first outside surface of said first support member; and said second stop means includes a second inside surface for adjacent location along said second outside surface of said second support member.

* * * * *